US010722043B2

(12) United States Patent
Leng

(10) Patent No.: US 10,722,043 B2
(45) Date of Patent: Jul. 28, 2020

(54) DETACHABLE PORTABLE SPRING BED

(71) Applicant: GRAND-ONE FURNITURE CO., LTD., Xiamen, Fujian (CN)

(72) Inventor: Luhao Leng, Fujian (CN)

(73) Assignee: GRAND-ONE FURNITURE CO., LTD., Xiamen (CN)

( * ) Notice: Subject to any disclaimer, the term of this patent is extended or adjusted under 35 U.S.C. 154(b) by 429 days.

(21) Appl. No.: 15/521,080

(22) PCT Filed: Oct. 23, 2015

(86) PCT No.: PCT/CN2015/092679

§ 371 (c)(1),
(2) Date: Apr. 21, 2017

(87) PCT Pub. No.: WO2016/066060

PCT Pub. Date: May 6, 2016

(65) Prior Publication Data

US 2017/0340129 A1 Nov. 30, 2017

(30) Foreign Application Priority Data

Oct. 27, 2014 (CN) ..... 2014 1 0584502

(51) Int. Cl.

| | |
|---|---|
| ***A47C 23/05*** | (2006.01) |
| ***A47C 23/04*** | (2006.01) |
| ***A47C 19/00*** | (2006.01) |
| ***A47C 23/00*** | (2006.01) |

(52) U.S. Cl.

CPC ..... *A47C 23/05* (2013.01); *A47C 19/005* (2013.01); *A47C 23/005* (2013.01); *A47C 23/04* (2013.01)

(58) Field of Classification Search

CPC ..... A47C 23/05; A47C 23/005; A47C 23/04; A47C 19/005

See application file for complete search history.

(56) References Cited

U.S. PATENT DOCUMENTS

| | | | | |
|---|---|---|---|---|
| 755,987 A | | 3/1904 | Anderson | |
| 1,124,031 A | * | 1/1915 | Kohler | A47C 23/05 5/264.1 |
| 3,953,903 A | * | 5/1976 | Lawrence | A47C 23/043 5/267 |
| 4,426,070 A | * | 1/1984 | Garceau | A47C 23/043 267/110 |
| 4,685,160 A | * | 8/1987 | Rizzardo | A47C 19/005 5/201 |
| 5,176,367 A | * | 1/1993 | Rodgers | A47C 23/005 267/103 |
| 5,184,802 A | * | 2/1993 | Galumbeck | A47C 23/05 267/103 |

(Continued)

FOREIGN PATENT DOCUMENTS

| | | |
|---|---|---|
| CN | 2380120 Y | 5/2000 |
| CN | 2380120 Y | 5/2000 |

(Continued)

*Primary Examiner* — Robert G Santos
*Assistant Examiner* — Rahib T Zaman
(74) *Attorney, Agent, or Firm* — Cooper Legal Group, LLC

(57) ABSTRACT

A detachable portable spring bed has a bed frame, a spring group, a cushion; the bed frame is detachable, wherein when used, the bed frame is held up, the spring is detachably assembled to the bed frame, the cushion is lay on the springs, when in packing state, the springs are detached and overlapped, the bed frame is detached to components; the spring group, the components of the bed frame, the cushion are collectively packed or independently packed. The bed frame, the spring group, the cushion are detachable.

10 Claims, 15 Drawing Sheets

(56) References Cited

U.S. PATENT DOCUMENTS

| | | | | | |
|---|---|---|---|---|---|
| 5,210,890 | A | | 5/1993 | Hagglund | |
| 5,749,108 | A | * | 5/1998 | Barnett | A47C 23/05 267/103 |
| 5,964,453 | A | * | 10/1999 | McCraw | A47C 23/0436 267/103 |
| 6,134,729 | A | * | 10/2000 | Quintile | A47C 23/002 267/103 |
| 2003/0028963 | A1 | * | 2/2003 | McCraw | A47C 23/06 5/246 |
| 2006/0079117 | A1 | * | 4/2006 | Voit | A47C 23/002 439/465 |
| 2011/0179580 | A1 | * | 7/2011 | Wieland | A47C 23/05 5/719 |
| 2015/0000229 | A1 | * | 1/2015 | Leng | B65B 13/20 53/410 |

FOREIGN PATENT DOCUMENTS

| | | | |
|---|---|---|---|
| CN | 2566715 | Y | 8/2003 |
| CN | 1478053 | A | 2/2004 |
| CN | 1729894 | A | 2/2006 |
| CN | 1822782 | A | 8/2006 |
| CN | 201070433 | Y | 6/2008 |
| CN | 201135278 | Y | 10/2008 |
| CN | 201658060 | U | 12/2010 |
| CN | 202154337 | U | 3/2012 |
| CN | 202698469 | U | 1/2013 |
| CN | 203207597 | U | 9/2013 |
| CN | 103449026 | A | 12/2013 |
| CN | 203662358 | U | 6/2014 |
| CN | 104510214 | A | 4/2015 |
| CN | 104510214 | A | 4/2015 |
| CN | 204580617 | U | 8/2015 |
| CN | 204580617 | U | 8/2015 |
| CN | 204580618 | U | 8/2015 |
| CN | 204580618 | U | 8/2015 |
| CN | 204580619 | U | 8/2015 |
| CN | 204580619 | U | 8/2015 |
| DE | 2848975 | A1 | 5/1980 |
| GB | 389191 | A | 3/1933 |
| JP | 2005198899 | A | 7/2005 |
| WO | 9502350 | A1 | 1/1995 |

* cited by examiner

DETACHABLE PORTABLE SPRING BED

FIELD OF THE INVENTION

The present invention relates to a spring bed, especially to a detachable portable spring bed.

BACKGROUND OF THE INVENTION

People are under working pressure more and more due to the fast city life, outdoor leisure activities like camping, self-driving travel are more and more popular. Usually, when camping, people can only sleep on a floor mats or in sleeping bags, due to the hard unsmooth ground, they sleep uncomfortable. In addition, the ground is humid that makes people get cold easily and have pain in the waist and back, especially bad for people have bad lumbar and neck vertebra, they are more difficult to sleep on the ground. Sometimes it rains at night, there is nowhere to run. Beds are the best bearing tool for people to sleep for a long time, but existing outdoor beds are inconvenient to transport, even some of them are detachable. The using effect of the bed is weakened.

SUMMARY OF THE INVENTION

The present invention is provided with a detachable portable spring bed, which overcomes the disadvantages of the existing technology. The technical proposal of the present invention to solve the technical problems is that:

A detachable portable spring bed, comprising a bed frame, a springs, a cushion; the bed frame is detachable, wherein when used, the bed frame is held up, the spring is detachably assembled to the bed frame, the cushion is lay on the springs, when in packing state, the springs are detached and overlapped, the bed frame is detached to components; the spring group, the components of the bed frame, the cushion are collectively packed or independently packed.

In another preferred embodiment, the bed frame comprises support legs, borders and cross beams, the borders are supported by the support legs, the cross beams are disposed between two borders, the cross beam is disposed with a plurality of fixing elements, the springs are detachably assembled to the fixing elements.

In another preferred embodiment, the springs are fixedly connected to the cross beams in locking way or in rotating way.

In another preferred embodiment, the top surface the border is disposed with a stop element, the cross beam is detachably connected to the stop element in locking way.

In another preferred embodiment, the spring group comprises a plurality of serpentine springs, the bed frame comprises support legs and borders, the bed frame is supported by the support legs, the serpentine springs are connected to the boards in hanging way.

In another preferred embodiment, the bed frame comprises support legs, borders and steel wire mesh, the borders are supported by the support legs, the steel wire mesh comprises a plurality of steel wires, the steel wires are disposed between two borders, a plurality of fixing elements are disposed between two steel wires, the springs are detachably assembled to the fixing elements.

In another preferred embodiment, the bed frame comprises support legs, borders and cross beams, the borders are supported by the support legs, the bed framer further comprises a flat board, the flat board is lay on the bed frame, the flat board is disposed with a plurality of fixing elements, the springs are detachably assembled to the fixing elements.

In another preferred embodiment, the bed frame comprises support legs, borders and cross beams, the borders are supported by the support legs, the bed frame further comprises a plastic board, the plastic board is lay on the bed frame, the plastic board is disposed with a plurality of concaves, the springs are disposed in the concaves.

In another preferred embodiment, when used, the cushion covered the spring groups, hooks or Velcro are used to fix the cushion.

A detachable portable spring bed, comprising a bed frame, a springs, a cushion; the bed frame is detachable, the bed frame comprises support legs, borders and cross beams, the borders are supported by the support legs, wherein the cross beams are disposed between two borders, a plurality of fixing elements are disposed in each cross beam or two adjacent cross beams, the springs are detachably connected to the fixing elements in locking way, the fixing element comprises two symmetrical locking ends, the locking ends lock the bottom portion of the springs; when used, the bed frame is held up, the springs are detachably assembled to the bed frames, the cushion is lay on the spring group.

In another preferred embodiment, two lock terminals of the fixing element are connecting together to dispose in two adjacent cross beams, or two lock terminals of the fixing element are independently fixing connected to two adjacent cross beams.

In another preferred embodiment, the top surface of the border is disposed with a fixing element, two sides of the limit element are respectively rolled inwardly to form a lock hook, the look hook is used to hook the cross beam.

In another preferred embodiment, the opposite sides of the two lock terminals of the fixing elements are respectively disposed with a lock groove to hook the spring.

In another preferred embodiment, two lock terminals of the fixing element are disposed in the same cross beam, the outer side of the lock terminals is disposed with an arc lock groove to hook the springs.

In another preferred embodiment, the end portion of the cross beam are disposed with an inert portion to be inserted to the border.

In another preferred embodiment, a sponge layer is connected to the bottom portion of the cushion.

A detachable portable spring bed, comprising a bed frame, springs and a cushion, the bed frame is detachable, the bed frame comprises support legs, borders and cross beams, the borders are supported by the support legs, wherein the cross beams are disposed between two frames, each cross beam is disposed with a plurality of fixing elements, the springs are detachably connected to the fixing elements in rotating way, the outer surface of the fixing elements is disposed with a check ring to hook the bottom portion of the springs; when used, the bed frame is held up, the springs are assembled to the cross beams, the cushion is lay on the springs; in packing state, one set of springs and the cross beam are detached independently, the bed frame are divided to a plurality of components, the springs with cross beam, the bed frame component and the cushion are packed in a unit or independently.

Compared to the existing known technology, the technical proposal of the present invention has advantages as follows:

1. the bed frame, the springs, the cushion are detachable that can be operated and used in recycle, so that it reduces the packing size, and it can be put into the car trunk for carrying with convenience. The bed frame supports the spring group, so that it avoids damp. The spring group and the cushion are soft that it makes the bed sleep with comfort.

2. the cushion covers the spring group, and it is fixed with hooks or Velcro, so that it improves the comfort.
3. the top surface of the border is disposed with stop element, two sides of the stop element are respectively rolled inwardly to form lock hook, the lock hook hooks the cross beam, it can be assembled and disassembled conveniently and fast.
4. a sponge layer is connected to the bottom portion of the cushion that it improves the softness of the cushion.
5. the spring group comprises serpentine springs, which have large size and are flat, so that they are connected in hanging way conveniently.

BRIEF DESCRIPTION OF THE DRAWINGS

The present invention will be further described with the drawings and the embodiments.

DETAILED DESCRIPTION OF THE EMBODIMENTS

The First Embodiment

Figure 1:
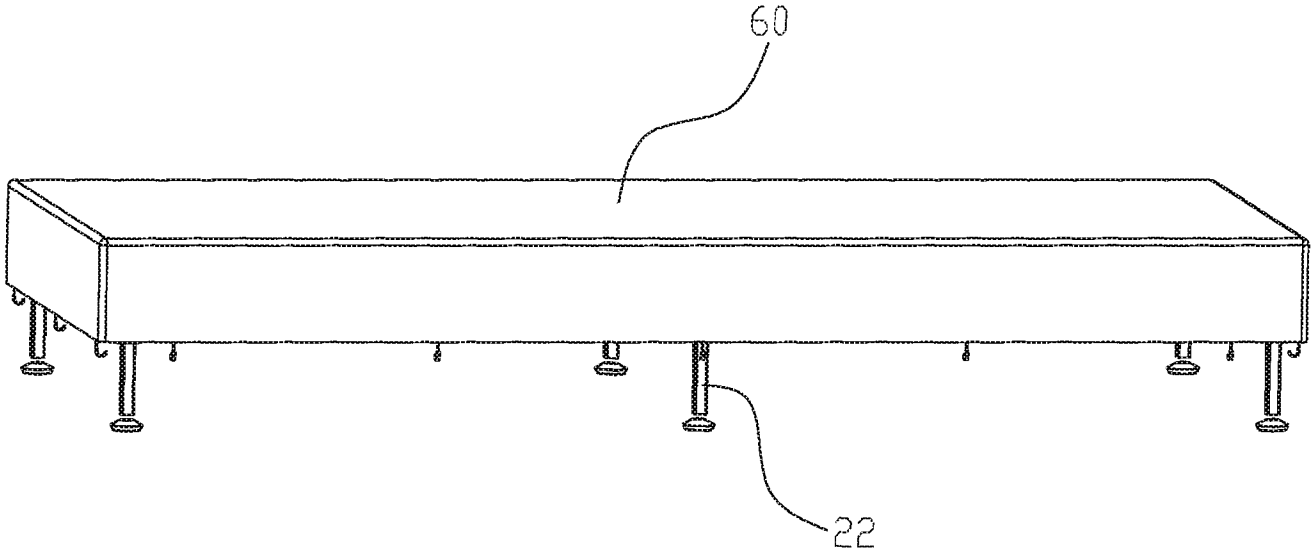
FIG. 1 illustrates a schematic diagram of a first embodiment of a detachable portable spring bed of the present invention.
Figure 2:
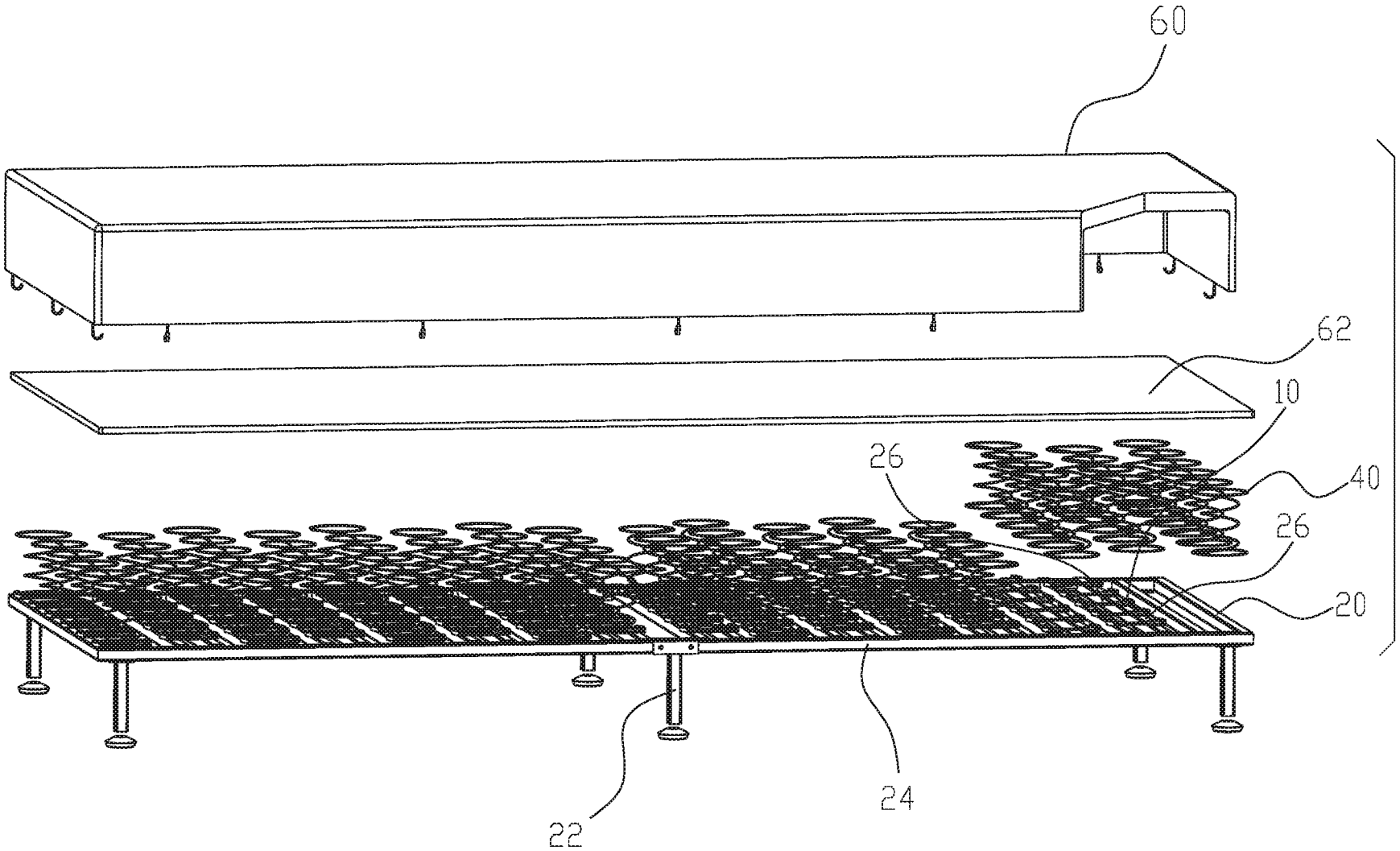
FIG. 2 illustrates an exploded and schematic diagram of the portable spring bed of FIG. 1.
Figure 4:
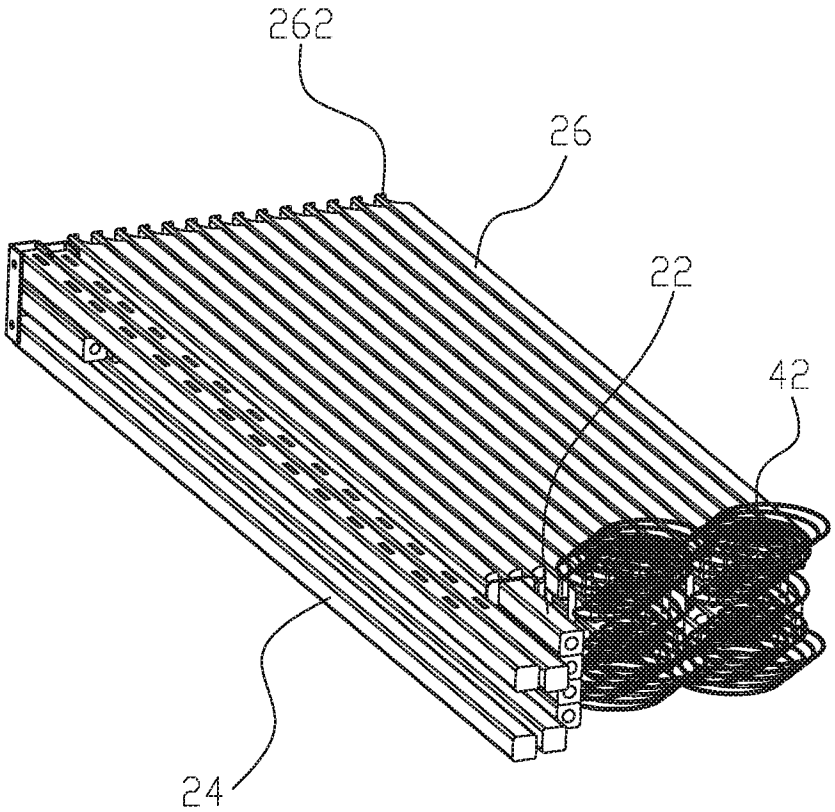
FIG. 4 illustrates a schematic diagram of the portable spring bed of FIG. 1 in package state.
Figure 3:
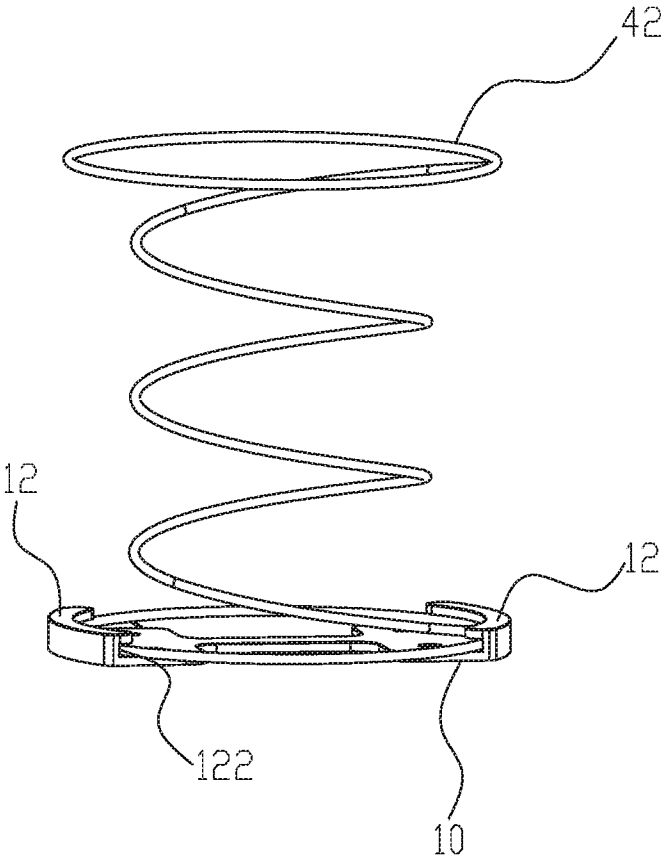
FIG. 3 illustrates a schematic diagram of the connecting of the spring and the fixing element of the portable spring bed of FIG. 1.

Referring to FIGS. 1~4, a detachable portable spring bed of the present invention comprises a bed frame 20, springs 42, a soft cushion 60. The bed frame 20 is detachable, when used, the bed frame 20 is held up, the spring group 40 is detachably assembled onto the bed frame 20, the soft cushion 60 is lay on the spring group 40, the bed is assembled completely. When in packing state, the springs are detached and overlapping together, or a spring group is detached; the bed frame 20 is detached to components, the spring group, the bed frame components, the soft cushion are packed collectively or independently.

The spring group 40 composes of a plurality of springs 42, in another case, a spring group is fixed to a cross beam 26, the cross beam 26 is separated from other components.

The bed frame 20 comprises a plurality of support legs 22, borders 24 and cross beams 26. The borders 24 are supported by the support legs 22. The cross beams 26 are disposed between two borders 24 with space in parallel. The end portions at two sides of the cross beam 26 are respectively disposed with an insert portion 262, the insert portions 262 are connected to the borders 24 in inserting way.

A plurality of fixing elements 10 are disposed between two adjacent cross beams 26, the springs 42 are detachably assembled to the fixing elements 10. The fixing element 10 comprises two lock terminals 12 symmetrically arranged, the lock terminals 12 are used to lock the bottom surface of the springs 42. Two lock terminals 12 of the fixing element 10 are integrally connected and then disposed to two adjacent cross beams 26. The opposite sides of the two lock terminals 12 of the fixing element 10 are respectively disposed with a lock groove 122 used to hook the spring 42, the lock groove 122 is arc shaped. When used, squeezing the spring 42 down to push the bottom ring to embed into the lock groove 122 can finish the assembly.

The bottom portion of the soft cushion 60 is disposed with a sponge layer 62. When used, the bed frame 20 is held up, the springs 42 are detachably assembled onto the bed frame 20, the soft cushion 62 covers the spring group 40, hooks or Velcro are used to fix the soft cushion 60.

The Second Embodiment

Figure 5:
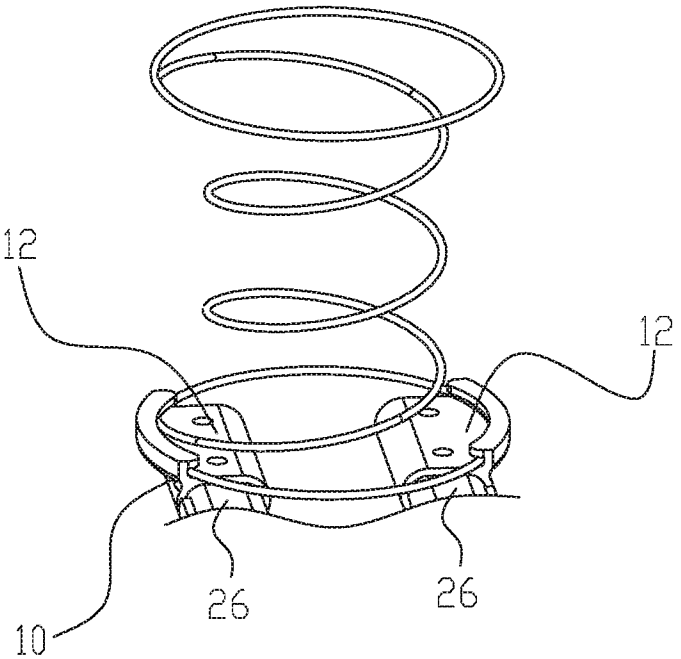
FIG. 5 illustrates a schematic diagram of the connecting of the spring and the fixing element of a second embodiment of the detachable portable spring bed.

Referring to FIG. 5, this embodiment differs from the first embodiment in that: two lock terminals 12 of the fixing element 10*a* are respectively configured and respectively fixed to two adjacent cross beams 26, the cross beams 26 are parallel arranged with space between the two boarders 24.

The Third Embodiment

Figure 6:
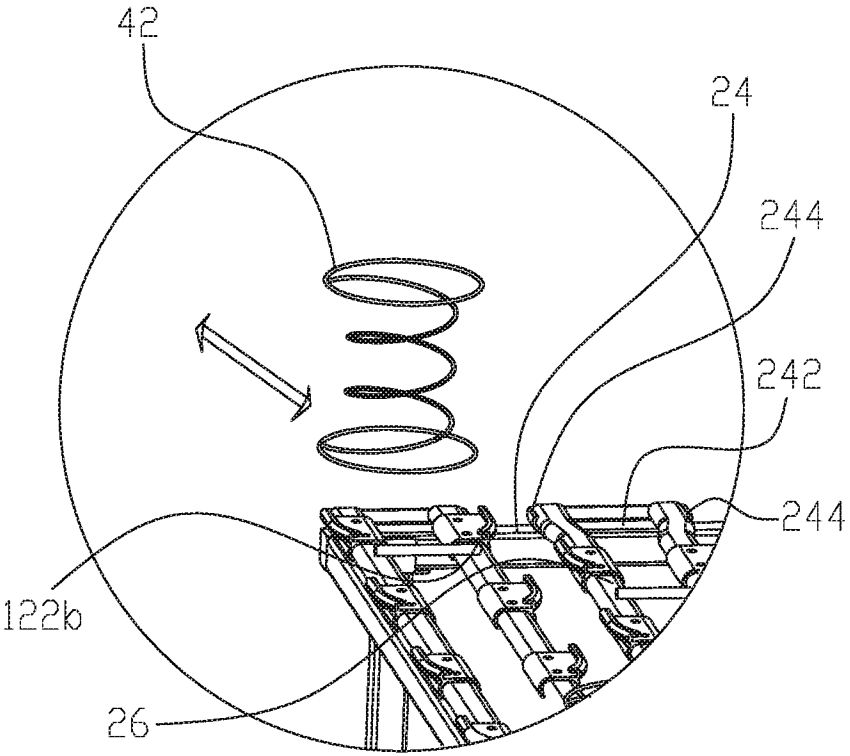
FIG. 6 illustrates a schematic diagram of the connecting of the spring and the fixing element of a third embodiment of the detachable portable spring bed.
Figure 7:
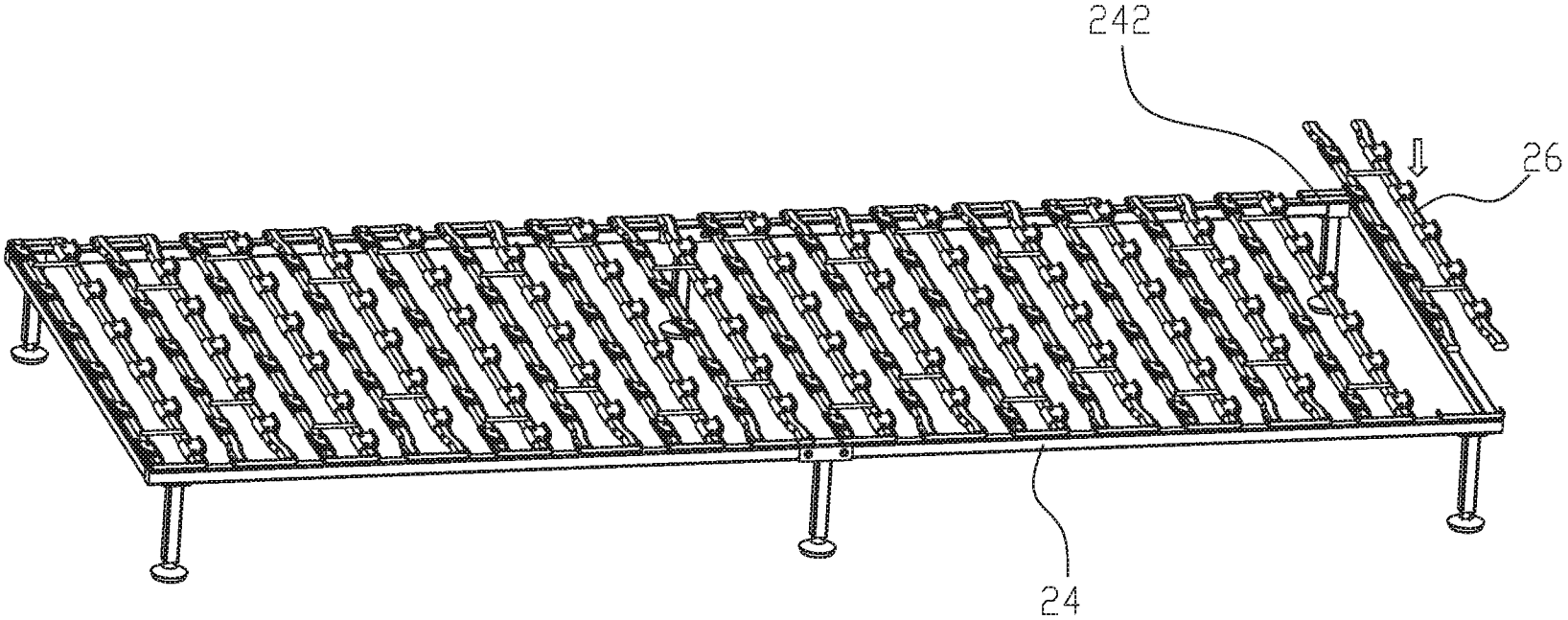
FIG. 7 illustrates a schematic diagram of a bed frame of the third embodiment of the detachable portable spring bed of the present invention.

Referring to FIG. 6 and FIG. 7, this embodiment differs from the second embodiment in that: the top portion of the border 24 is disposed with a stop element 242, two sides of the stop element 242 are respectively rolled to form a lock hook 244, two fixedly connected cross beams 26 are embedded between the two lock hooks 244, the lock hooks 244 hook the cross beams 26; the lock groove 122*b* are J shaped with a straight section and an arc section, so that the spring 42 can be pushed laterally from the side and then locked to the lock groove 122*b*.

The Fourth Embodiment

Figure 8:
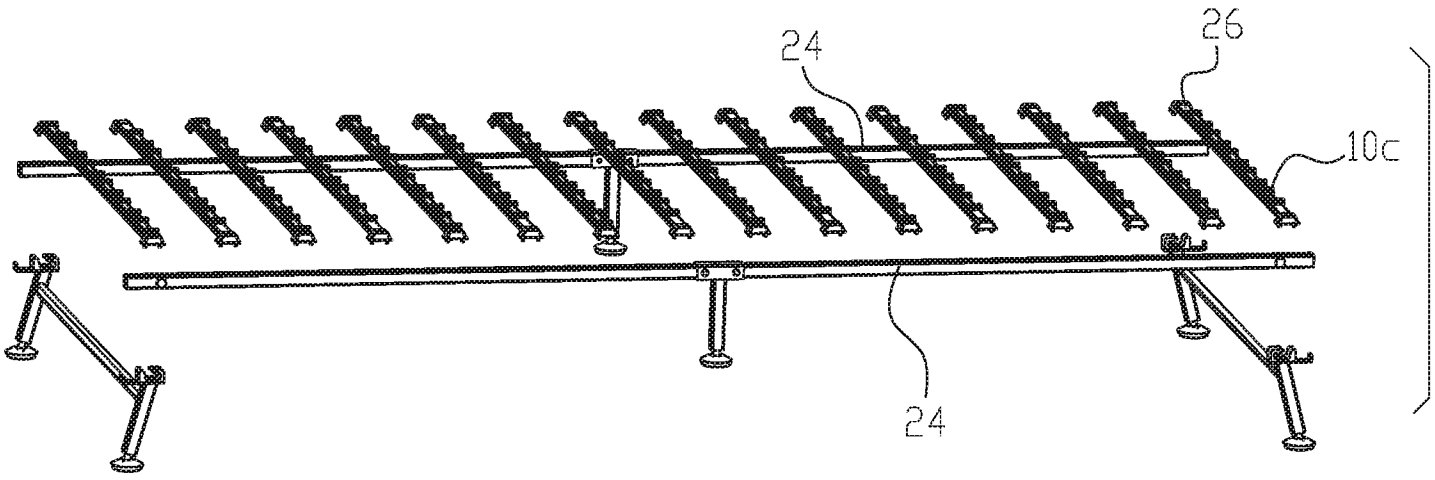
FIG. 8 illustrates a schematic diagram of a bed frame of a fourth embodiment of the detachable portable spring bed of the present invention.
Figure 9:
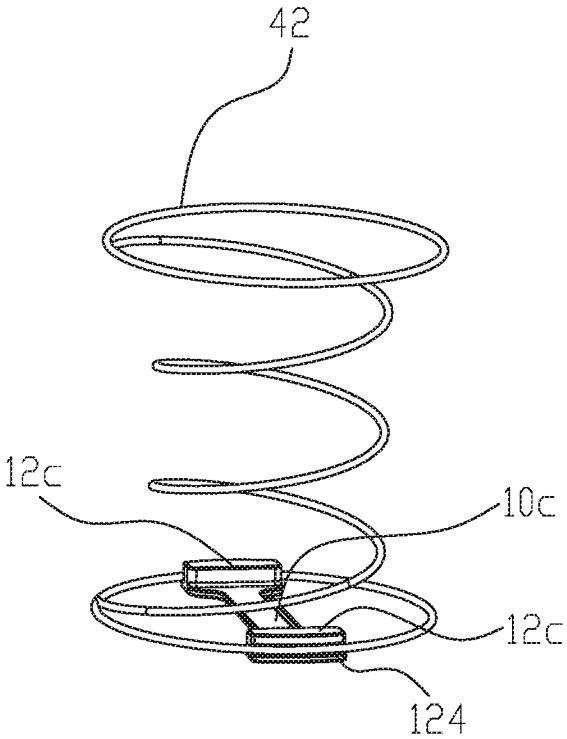
FIG. 9 illustrates a schematic diagram of the connecting of the spring and the fixing element of the fourth embodiment.

Referring to FIG. 8 and FIG. 9, this embodiment differs from the first embodiment in that: the fixing element 10*c* is fixed to a cross beam 26, the external side of the lock terminal 12*c* of the fixing element 10*c* is disposed with an arc lock groove 124 to hook the spring. When assembling, the spring 42 is sleeved on the fixing element 10*c*, the bottom ring of the spring 42 is clamped in the arc lock groove 124. When in packing, the springs are detached individually, in another case, the spring group at one cross beam 26 is detached from other components of the bed for package and transportation.

The Fifth Embodiment

Figure 10:
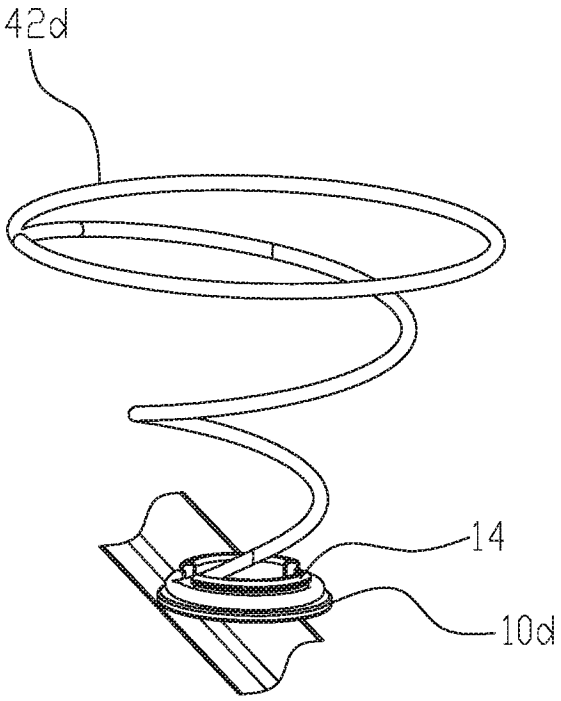
FIG. 10 illustrates a schematic diagram of the spring and the fixing element of a fifth embodiment of the detachable portable spring bed of the present invention.
Figure 11:
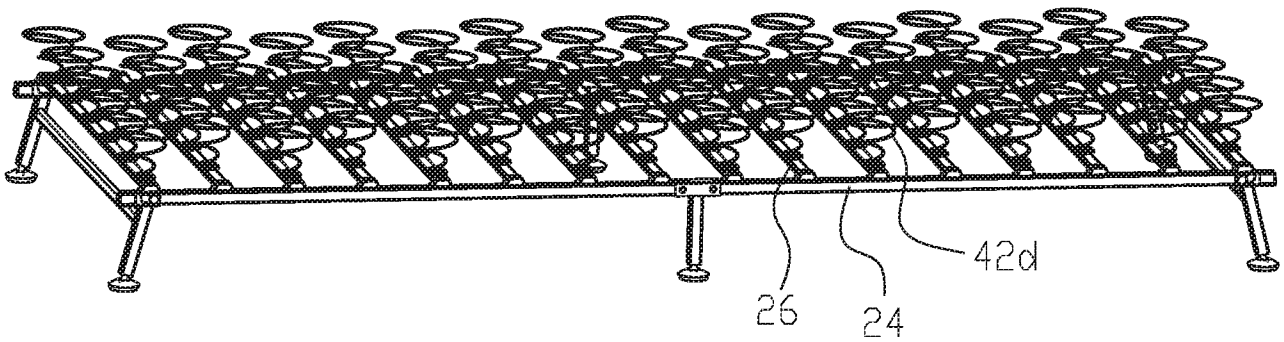
FIG. 11 illustrates a schematic diagram of the connecting of the spring group and the bed frame of the fifth embodiment.
Figure 12:
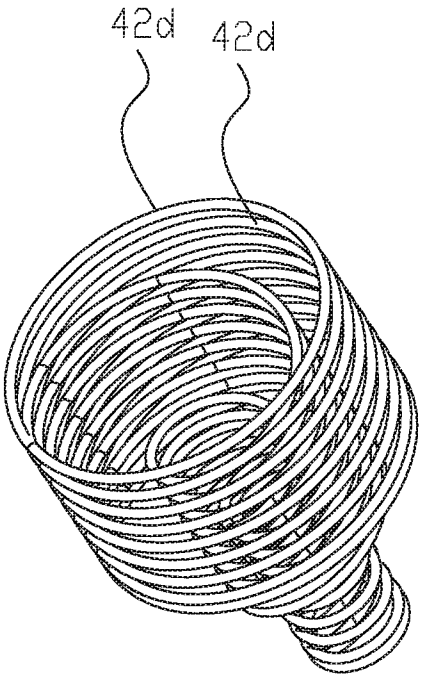
FIG. 12 illustrates a schematic diagram of the springs of the fifth embodiment when the springs are overlapping together.

Referring to FIG. 10-12, this embodiment differs from the fourth embodiment in that: the fixing element 10*d* is regular boss shaped with a central concave, the outer surface of the fixing element 10*d* is disposed with a check ring 14, the spring 42*d* is detachably connected to the fixing element 10*d* in rotating way, the check ring 14 hooks the bottom portion of the spring 42*d*. When in packing, the springs 42*d* can be nested together.

The Sixth Embodiment

Figure 13:
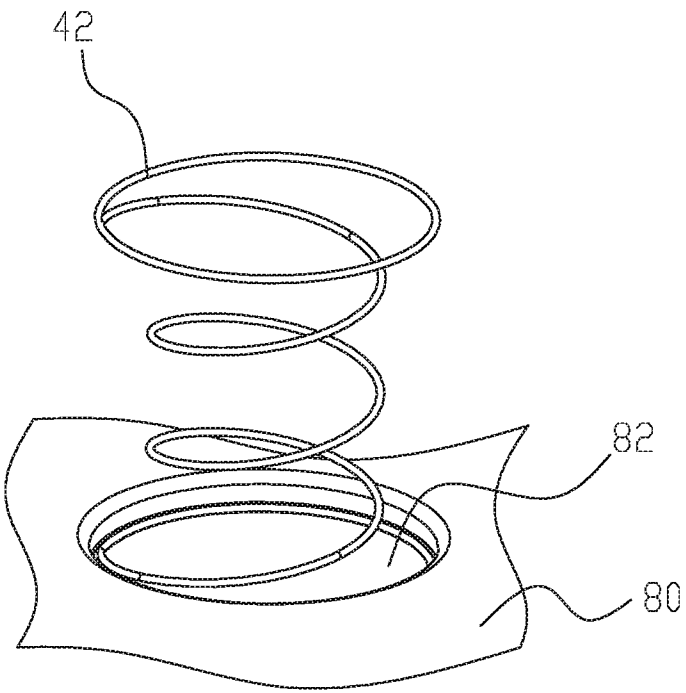
FIG. 13 illustrates a schematic diagram of the connecting of the spring and the plastic plate of a sixth embodiment of the detachable portable spring bed of the present invention.
Figure 14:
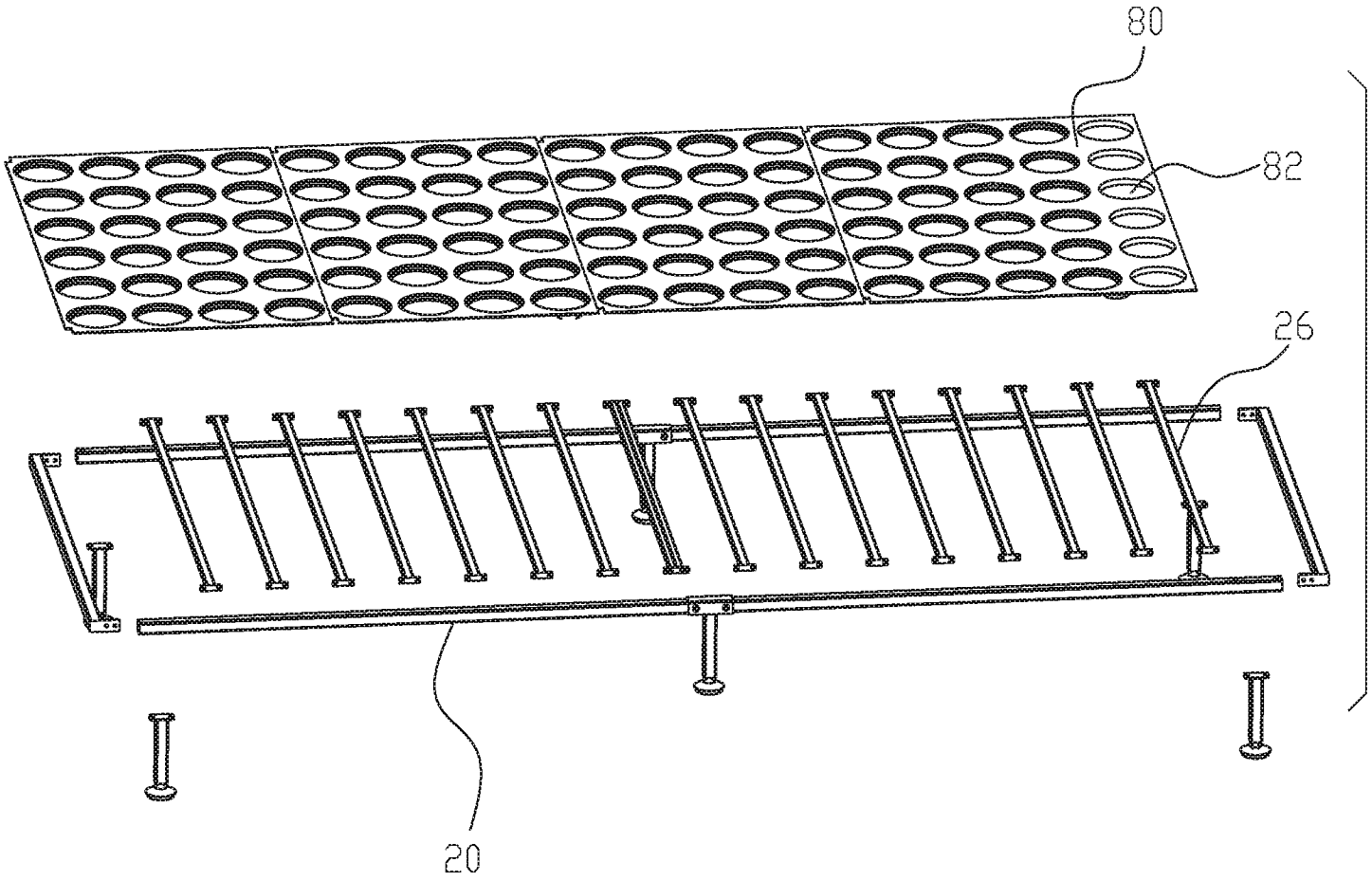
FIG. 14 illustrates a schematic diagram of the bed frame and the plastic plate of the sixth embodiment.

Referring to FIG. 13 and FIG. 14, this embodiment differs from the first embodiment in that: it further comprises a plurality of plastic plates 80 that are lay on the bed frame 20, the plastic plates 80 are supported on the cross beams 26, the plastic plates 80 are disposed with a plurality of concaves 82, the springs 42 can be detachably locked in the concaves 82, preferred, the side wall of the concaves 82 is disposed with a rib to press the spring 42. The plastic plate 80 comprises a plurality of plate units combining together.

The Seventh Embodiment

Figure 15:
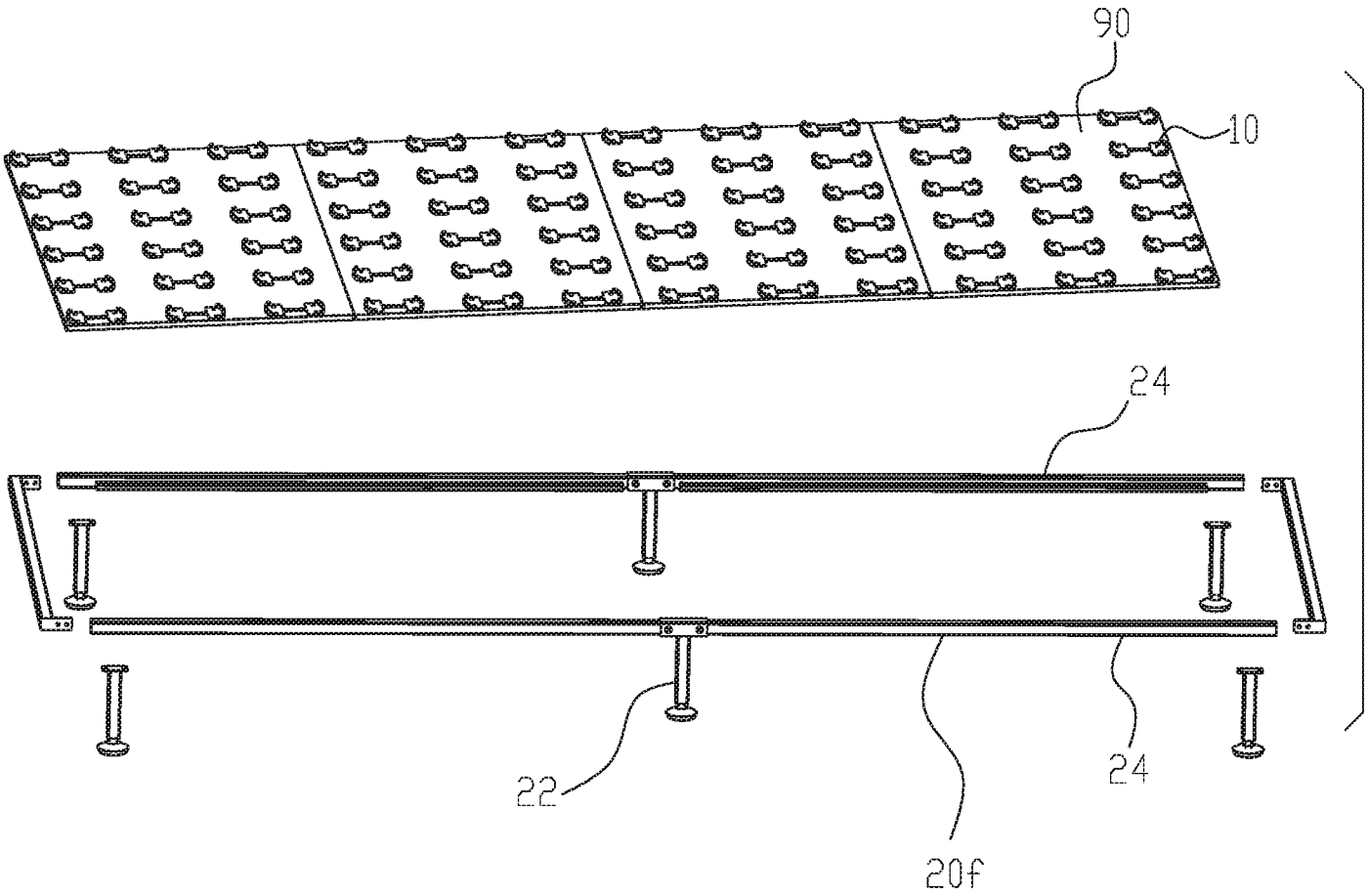
FIG. 15 illustrates a schematic diagram of the bed frame and the plastic plate of a seventh embodiment of the detachable portable spring bed of the present invention.
Figure 16:
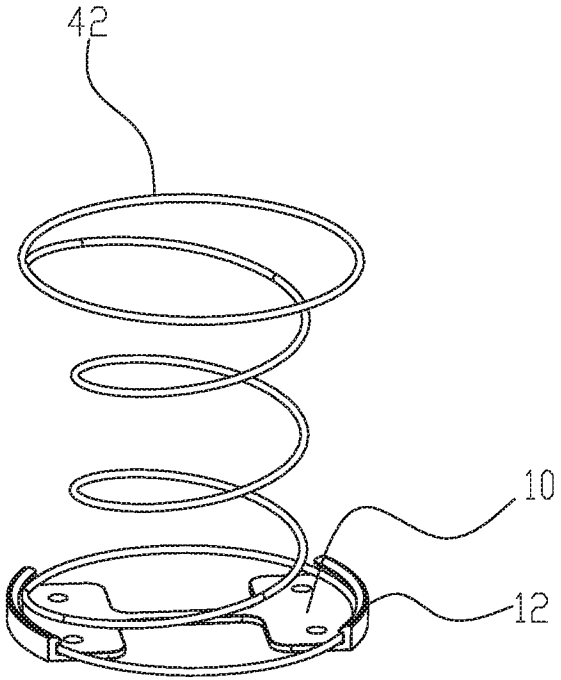
FIG. 16 illustrates a schematic diagram of the connecting of the spring and the fixing element of the seventh embodiment.

Referring to FIG. 15 and FIG. 16, this embodiment differs from the first embodiment in that: the bed frame 20*f* comprises a plurality of support legs and borders 24; it further comprises a plurality of flat boards 90, the flat boards 90 are lay on the borders 24, the fixing elements 10 are fixedly connected to the flat boards 90. When assembling, the springs 42 are detachably locked to the fixing elements 10.

The Eighth Embodiment

Figure 17:
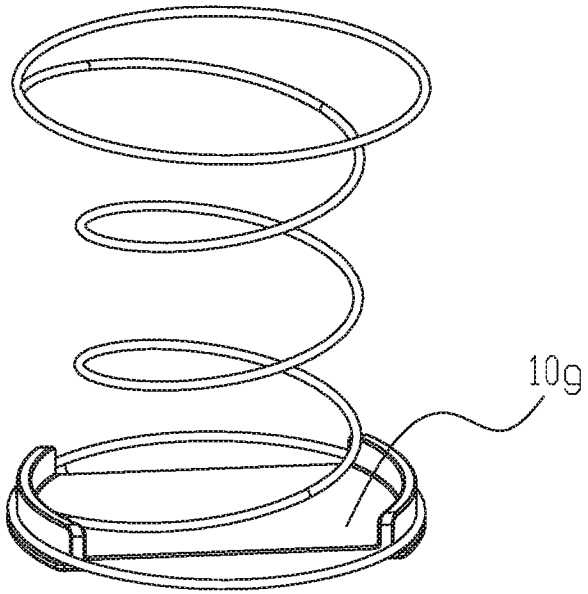
FIG. 17 illustrates a schematic diagram of the connecting of the spring and the fixing element of an eighth embodiment of the detachable portable spring bed of the present invention.
Figure 18:
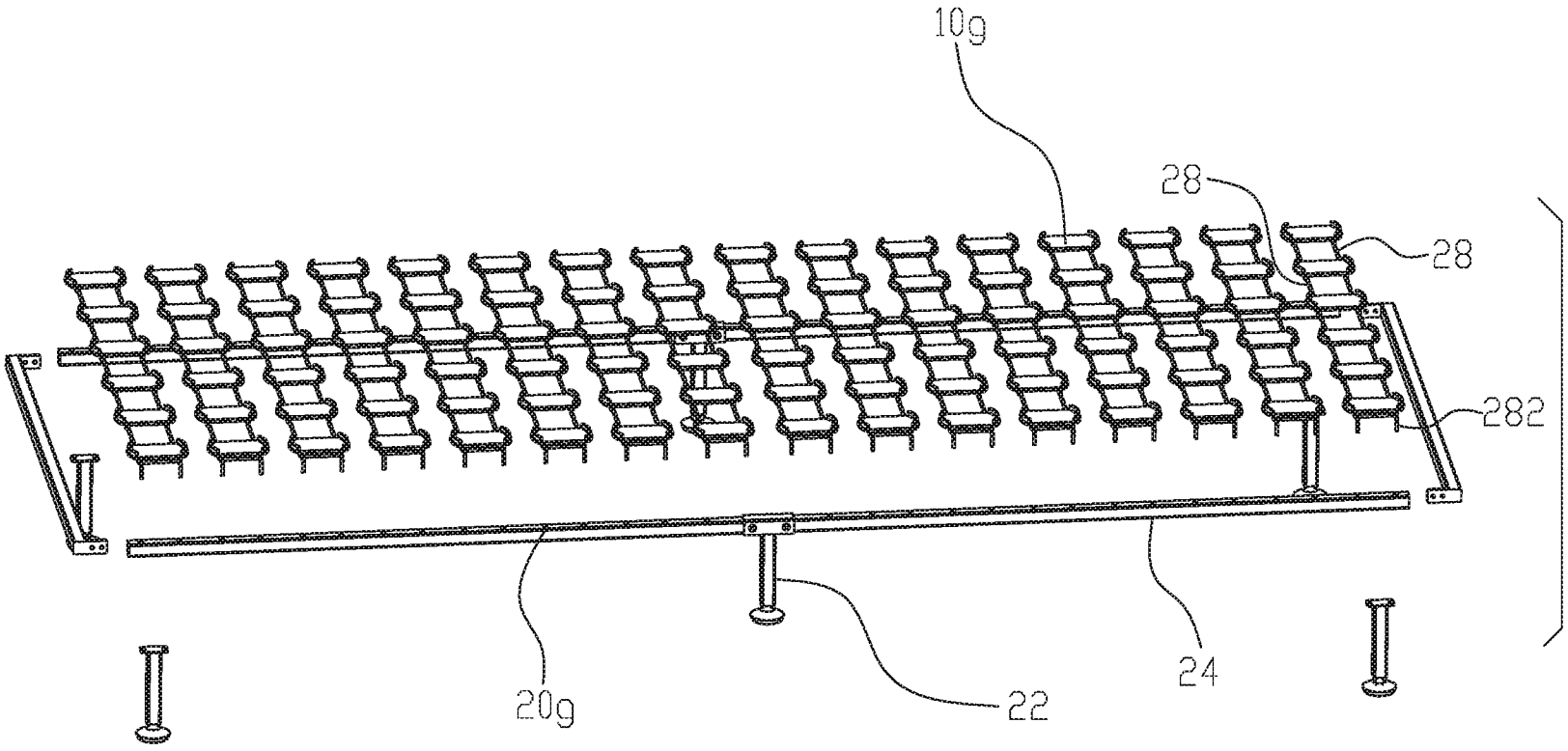
FIG. 18 illustrates a schematic diagram of the bed frame and the fixing element of the eighth embodiment.

Referring to FIG. 17 and FIG. 18, this embodiment differs from the first embodiment in that: the bed frame 20*g* comprises a plurality of support legs 22, borders 24 and a steel wire mesh, the steel wire mesh comprises steel wires 28 that are disposed between two borders 24, the end portion of the steel wire 28 is roller downwardly to form a connecting section 282, the connecting section 282 is inserted to the border 24; a plurality of fixing element 10*g* are disposed between two steel wires 28, the springs 42 are sleeved on the fixing elements 10*g*, the springs 42 are detachably locked to the fixing element 10*g*.

The Ninth Embodiment

Figure 19:
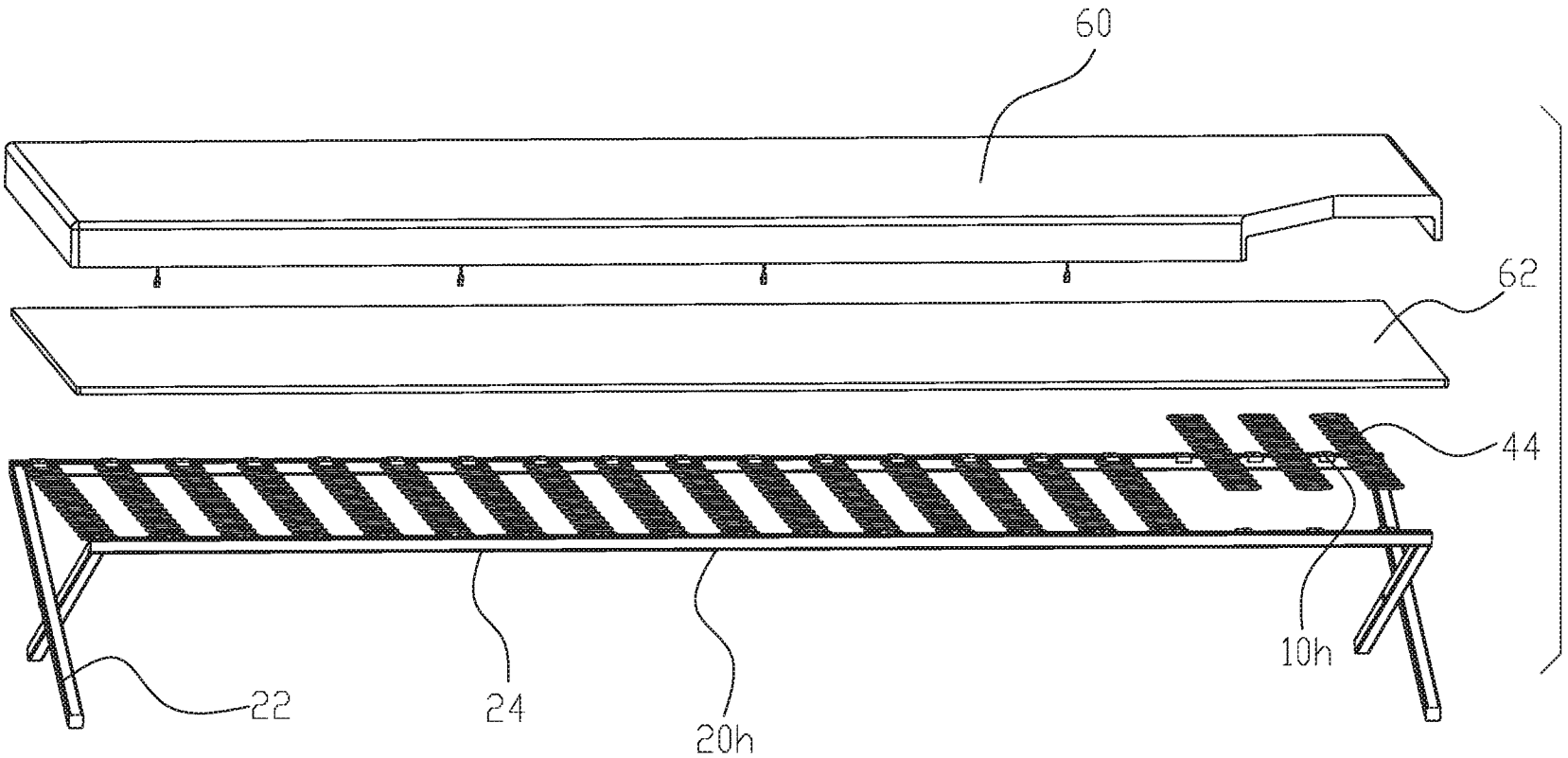
FIG. 19 illustrates an exploded diagram of a fifth embodiment of the detachable portable spring bed of the present invention.
Figure 20:
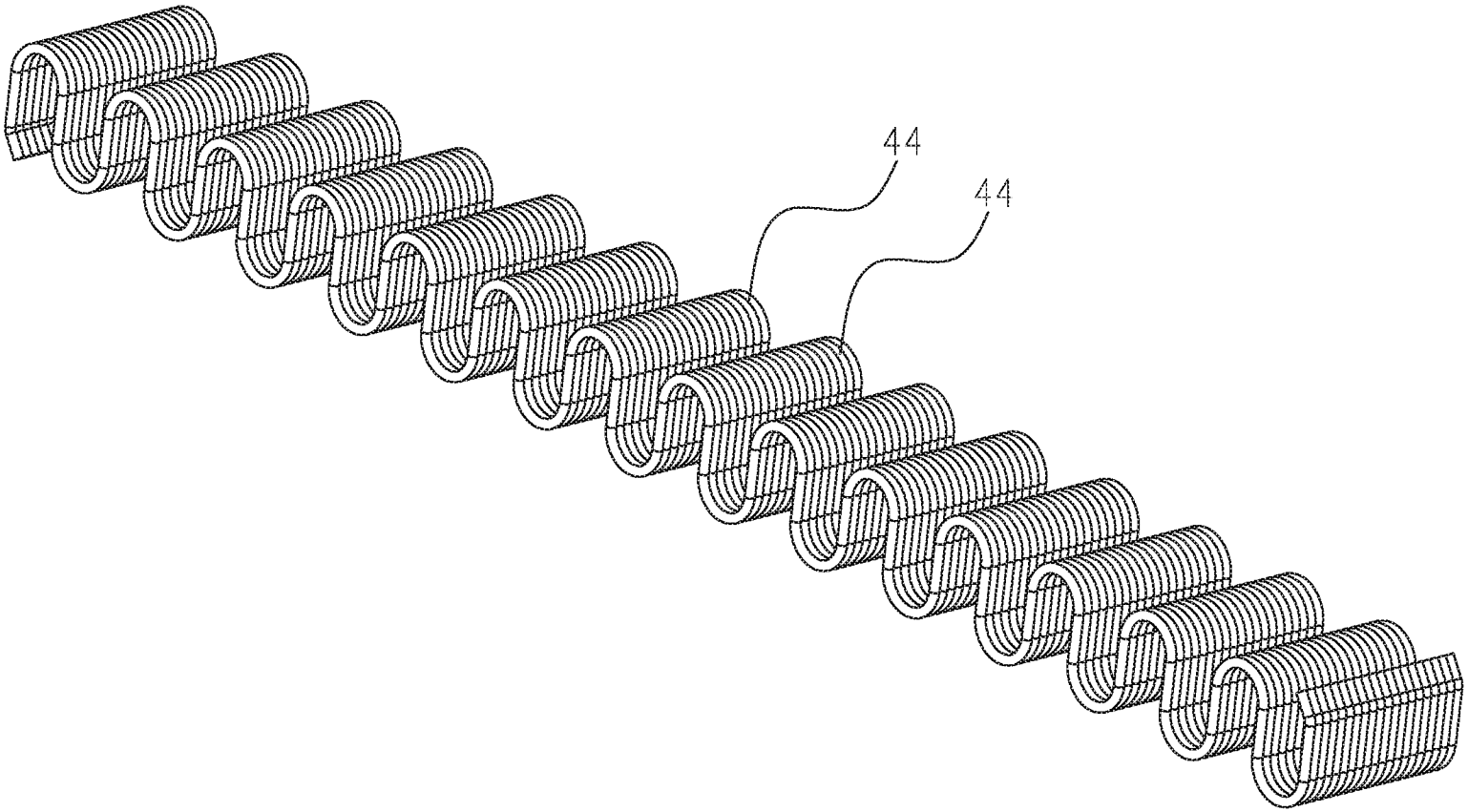
FIG. 20 illustrates a schematic diagram of the springs of the ninth embodiment when the springs are overlapping together.

Referring to FIG. 19 and FIG. 20, this embodiment differs from the first embodiment in that: the bed frame 20*h* comprises a plurality of support legs 22 and a plurality of borders 24, the fixing element 10*h* are hook structural and are fixedly connected to the inner side of the borders 24; the spring group comprises a plurality of serpentines springs 44 that are detachably connected to the fixing elements 10*h* in hanging way, two ends of the serpentines springs 44 are respectively connected to the fixing elements 10*h* of two borders 24 in hanging way. When in packing, the serpentines springs 44 are overlapped in order.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

INDUSTRIAL APPLICABILITY

The present invention is provided that the bed frame, the springs, the cushion are detachable that can be operated and used in recycle, so that it reduces the packing size, and it can be put into the car trunk for carrying with convenience. The bed frame supports the spring group, so that it avoids damp. The spring group and the cushion are soft that it makes the bed sleep with comfort.

The invention claimed is:

1. A detachable portable spring bed, comprising:
a bed frame,
a plurality of springs, and
a cushion, wherein:
the bed frame is configured to be disassemble,
the bed frame comprises a plurality of support legs, two borders and a plurality of cross beams,
the two borders are supported by the plurality of support legs,
each of the plurality of cross beams is disposed between the two borders,
each of a plurality of fixing elements is disposed between a first cross beam of the plurality of cross beams and a second cross beam of the plurality of cross beams,
the first cross beam is adjacent to the second cross beam,
each of the plurality of fixing elements is symmetrically disposed with two locking ends,
the two locking ends of each of the plurality of fixing elements are connected together or independently disposed on the first cross beam and the second cross beam,
each of the plurality of springs is detachably locked to connect to a corresponding one of the plurality of fixing elements,
the two locking ends lock a bottom portion of a corresponding one of the plurality of springs,
when the detachable portable spring bed is unfolded, the bed frame is assembled, the plurality of springs are detachably connected to the bed frame, and the cushion is disposed on the plurality of springs.

2. The detachable portable spring bed according to claim 1, wherein:

a top surface of each of the two borders is disposed with a plurality of positioning elements, two sides of each of the plurality of positioning elements are respectively rolled inwardly to define a lock hook, and the lock hook is configured to hook to a corresponding one of the plurality of cross beams.

3. The detachable portable spring bed according to claim 1, wherein opposite sides of the two locking ends are respectively disposed with a lock groove to hook to the corresponding one of the plurality of springs.

4. The detachable portable spring bed according to claim 1, wherein two end portions of each of the plurality of cross beams are respectively disposed with an insertion portion configured to be inserted into a corresponding one of the two borders.

5. The detachable portable spring bed according to claim 1, wherein a sponge layer is disposed on a bottom portion of the cushion.

6. A detachable portable spring bed, comprising:

a bed frame, a plurality of springs, and a cushion, wherein:

the bed frame is configured to be disassemble, the bed frame comprises a plurality of support legs, two borders, and a plurality of cross beams, the two borders are supported by the plurality of support legs, each of the plurality of cross beams is disposed between the two borders, each of a plurality of fixing elements is symmetrically disposed with two locking ends, the two locking ends of each of the plurality of fixing elements are disposed on a corresponding one of the plurality of cross beams, an outer side of the two locking ends is disposed with an arc lock groove to hook a corresponding one of the plurality of springs, each of the plurality of springs is detachably locked to connect to a corresponding one of the plurality of fixing elements, the two locking ends lock a bottom portion of a corresponding one of the plurality of springs, when the detachable portable spring bed is unfolded, the bed frame is assembled, the plurality of springs are detachably connected to the bed frame, and the cushion is disposed on the plurality of springs.

7. The detachable portable spring bed according to claim 6, wherein two end portions of each of the plurality of cross beams are respectively disposed with an insertion portion configured to be inserted into a corresponding one of the two borders.

8. The detachable portable spring bed according to claim 6, wherein a sponge layer is disposed on a bottom portion of the cushion.

9. A detachable portable spring bed, comprising:

a bed frame, a plurality of springs, and a cushion, wherein:

the bed frame is configured to be disassemble, the bed frame comprises a plurality of support legs, two borders, and a plurality of cross beams, the two borders are supported by the plurality of support legs, each of the plurality of cross beams is disposed between two borders, each of a plurality of fixing elements is disposed on a corresponding one of the plurality of cross beams or between a first cross beam of the plurality of cross beams and a second cross beam of the plurality of cross beams, the first cross beam is adjacent to the second cross beam, each of the plurality of fixing elements is symmetrically disposed with two locking ends, each of the plurality of springs is detachably locked to connect to a corresponding one of the plurality of fixing elements, the two locking ends lock a bottom portion of a corresponding one of the plurality of springs, two end portions of each of the plurality of cross beams are respectively disposed with an insertion portion configured to be inserted into a corresponding one of the two borders, and when the detachable portable spring bed is unfolded, the bed frame is assembled, the plurality of springs are detachably connected to the bed frame, and the cushion is disposed on the plurality of springs.

10. The detachable portable spring bed according to claim 9, wherein a sponge layer is disposed on a bottom portion of the cushion.

* * * * *